US009314144B2

(12) United States Patent
Bayer et al.

(10) Patent No.: US 9,314,144 B2
(45) Date of Patent: Apr. 19, 2016

(54) SPRAY ARM ASSEMBLY FOR A DISHWASHER

(75) Inventors: Matthias Bayer, Zirndorf (DE); Friedrich Mack, Nuremberg (DE); Oliver Kleinert, Lidingo (SE); Richard Schadt, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1188 days.

(21) Appl. No.: 13/146,771

(22) PCT Filed: Feb. 9, 2010

(86) PCT No.: PCT/EP2010/000781

§ 371 (c)(1),
(2), (4) Date: Oct. 17, 2011

(87) PCT Pub. No.: WO2010/089149

PCT Pub. Date: Aug. 12, 2010

(65) Prior Publication Data

US 2012/0037193 A1 Feb. 16, 2012

(30) Foreign Application Priority Data

Feb. 9, 2009 (EP) ..... 09001761

(51) Int. Cl.
*A47L 15/23* (2006.01)

(52) U.S. Cl.
CPC ..... *A47L 15/23* (2013.01)

(58) Field of Classification Search
CPC ..... A47L 15/23; A47L 15/22
See application file for complete search history.

(56) References Cited

U.S. PATENT DOCUMENTS 5,433,228 A 7/1995 Dingler
5,464,482 A * 11/1995 Michael et al. ..... 134/25.2

(Continued)

FOREIGN PATENT DOCUMENTS

DE 196 42 911 A1 4/1998
DE 10 2004 043 772 A1 3/2006

(Continued)

OTHER PUBLICATIONS

International Search Report from International Application No. PCT/EP2010/000781, filed Feb. 9, 2010.

(Continued)

*Primary Examiner* — Michael Barr
*Assistant Examiner* — Spencer Bell
(74) *Attorney, Agent, or Firm* — Alston & Bird LLP

(57) ABSTRACT

A spray arm assembly for a dishwasher, comprising a spray arm (12; 74) comprising a plurality of spraying nozzles (40, 42, 60; 76), and support means (16; 56; 78) comprising a mounting element (18; 50; 80) for mounting the support means within the dishwasher and a support member (20; 54; 82) on which the spray arm (12; 74) rests during periods of non-use. The spray arm assembly is characterized in that it further comprises —first supplemental outlet means (24, 48, 58; 92) to direct, during periods of use, liquid to between the support member (20; 54; 82) and the spray arm (12; 74) so as to form a liquid layer between the support member and the spray arm, on which liquid layer the spray arm floats during rotation, and —second supplemental outlet means (28; 86) to direct, during periods of use, liquid to between the spray arm (12, 74) and a guiding surface (34) provided at the support means, so as to stabilize rotation of the spray arm.

12 Claims, 7 Drawing Sheets

(56) References Cited

U.S. PATENT DOCUMENTS

| | | | | |
|---|---|---|---|---|
| 2005/0241681 | A1 | 11/2005 | Hwang | |
| 2009/0145981 | A1 * | 6/2009 | Mack et al. | 239/261 |

FOREIGN PATENT DOCUMENTS

| | | | |
|---|---|---|---|
| EP | 0 172 535 | A | 2/1986 |
| EP | 1 510 168 | A | 3/2005 |
| GB | 2 233 220 | A | 1/1991 |
| WO | WO 2006/048074 | A | 5/2006 |

OTHER PUBLICATIONS

Extended European Search Report for corresponding European Patent Application No. 09001761.7 dated Jul. 8, 2009.

Written Opinion from corresponding International Application No. PCT/EP2010/000781, mailed Nov. 3, 2010.

* cited by examiner

SPRAY ARM ASSEMBLY FOR A DISHWASHER

CROSS REFERENCE TO RELATED APPLICATIONS

This application is a national stage application filed under 35 U.S.C. 371 of International Application No. PCT/EP2010/000781, filed Feb. 9, 2010, which claims priority from European Application No. 09001761.7, filed Feb. 9, 2009, each of which is incorporated herein in its entirety.

The present invention is directed to a spray arm assembly for a dishwasher, the spray arm assembly comprising a spray arm having a plurality of spraying nozzles, and a support means for rotational arrangement of the spray arm, wherein said support means comprises a mounting element for mounting the support means within the dishwasher and a support member on which the spray arm rests during periods of non-use.

Conventional dishwashers, such as domestic dishwashers, have a tub defining a wash chamber with a front opening. Typically, upper and lower wire racks are disposed within the wash chamber to hold objects to be washed. In such conventional dishwashers usually the upper and the lower racks are horizontally movable through the front opening so as to provide access to the objects to be washed.

In such dishwashers, an example of which is shown in WO 2006/048074 A1, it is known to provide at least one spray arm for distributing wash liquid throughout the washing compartment. In most dishwashers a lower spray arm is mounted rotatably on a hub below the lower rack, and an upper spray arm is mounted rotatably below the upper rack. Additionally or alternatively an upper spray arm may be suspended from the top wall of the washing compartment so as to be rotatable.

The spray arms usually are hollow members which comprise a number of spraying nozzles through which water jets are directed onto the goods to be washed. In order to cause the spray arm to rotate when water is fed to the spray arm, at least one of the water jets is ejected from the spray arm at an angle with respect to the axis of rotation of the spray arm, so as to impart a rotating force on the spray arm.

Since the washing liquid which by means of the spray arms is sprayed onto the goods to be washed usually is circulated within the dishwasher, i.e. upon dripping of from the washing goods is collected in the sump of the dishwasher, is filtered and is again fed to the spray arms, the spray arms have to be mounted so as to be removable for cleaning purposes. For this reason and considering that the spray arms are exposed to the detergent containing washing liquid, it is not feasible, and with conventional spray arm design not possible, to provide for lubrication at the hubs on which the spray arms rotate. Therefore, during rotation of the spray arms a considerable amount of friction is created which may cause abrasion of the surfaces of the spray arm and/or the hub.

Therefore it is an object of the present invention to provide a spray arm assembly for a dishwasher, in which during rotation of the spray arm less friction is created at the hub if the spray arm.

In spray arm assembly for a dishwasher, wherein the spray arm assembly comprises a spray arm having a plurality of spraying nozzles, and support means comprising a mounting element for mounting the support means within the dishwasher and a support member on which the spray arm rests during periods of non-use, this object is solved in accordance with the present invention in that the spray arm assembly further comprises first supplemental outlet means to direct, during periods of use, liquid to between the support member and the spray arm so as to form a liquid layer between the support member and the spray arm, on which liquid layer the spray arm floats during rotation, and second supplemental outlet means to direct, during periods of use, liquid to between the spray arm and a guiding surface provided at the support means, so as to stabilize rotation of the spray arm.

The present invention thus provides a spray arm assembly wherein during periods of use, i.e. when cleaning liquid is supplied to the spray arm so as to be sprayed onto the articles to be washed, liquid is supplied to the bearing surfaces, i.e. to the regions where the spray arm is supported both in axial and in radial direction. Since the cleaning liquid thus acts as an intermediate layer on which the spray arm floats during rotation, friction is substantially reduced.

It should be understood that in order to provide that the spray arm floats during rotation, the axial forces acting on the spray arm have to be substantially balanced. Thus, in embodiments where the cleaning liquid is fed into the spray arm from below, the upward buoyancy force resulting from the liquid which is fed under pressure into the spray arm has to be adjusted so as to balance the gravitational force acting on the spray arm, i.e. the weight of the spray arm. Particularly in embodiments where the spray arm is designed as a lightweight hollow plastic part, the second supplemental outlet means acts as a pressure relief opening, so as to limit the upward buoyancy force created by the pressurized cleaning liquid that is fed into the spray arm to an amount which roughly balances the weight of the spray arm.

Particularly in embodiments where the cleaning liquid is fed into the spray arm from below, the spray arm assembly can preferably be designed such that the resulting upward buoyancy force during use is less than the weight of the spray arm. In such embodiments retention means for axially securing the spray arm can be omitted, which substantially facilitates mounting and demounting of the spray arm and thus provides for cost savings during manufacture and for ease of use when a user wants to disassemble and reassemble the spray arm for cleaning purposes.

Preferred embodiments of the present invention are defined in the depending claims.

In particular, the mounting element can comprise a liquid inlet for the spray arm, in particular a generally ring-shaped element, which forms a liquid inlet for the spray arm, and which on its exterior side is provided with fixing means for fixing the mounting element with respect to a dishwasher. Such fixing means can comprise, for example, a thread or at least one catch which engages a counterpart that is provided in the dishwasher. If, for example, the spray arm is to be rotatably mounted close to the bottom of the wash chamber, the counterpart could be a thread that is provided fixedly in the bottom of the wash chamber, so as to be in communication with a feed line to which cleaning liquid is fed via a circulation pump. If, on the other hand, the spray arm assembly comprises the satellite arm of a sun arm/satellite arm assembly, i.e. an assembly wherein a sun arm, which is rotatably mounted in the wash chamber, carries at least one, more commonly two, satellite arms, which are rotatably mounted at ends of the sun arm, the counterpart could be a thread that is provided in a liquid feed open of the sun arm. The basic construction of the sun arm/satellite arm assembly can be designed, for example, as it is known from EP 1 510 168 A2 or from DE 10 2004 043 772 A1

The spray arm can be designed as a hollow member comprising a central opening in both its upper and lower walls, wherein the support means extends vertically through the spray arm and comprises a closing member which substantially closes the opening in the wall of the spray arm that is located opposite the liquid inlet. Preferably, the above-mentioned second supplemental outlet means are defined according to the present invention by both, said closing member which substantially closes the opening in the wall of the spray arm that is located opposite the liquid inlet and said opening in said wall of the spray arm that is located opposite said liquid inlet. Depending on whether the spray arm is to be mounted from above or from below, i.e. in suspended fashion, the closing member can be provided with locking means to axially secure the spray arm after it has been mounted onto the support means.

In such embodiments, the closing member can be connected to the mounting element by a plurality of ribs, fins or struts.

Preferably, the closing member is provided with a liquid deflection surface, such as a curved surface, so as to laterally direct cleaning liquid entering the liquid inlet into the interior of the spray arm and thus to the spraying nozzles.

In embodiments in which the liquid inlet is provided at the bottom side of the spray arm, the first supplemental outlet means preferably is formed by providing for a predetermined axial and/or radial play between the spray arm and the support member, and the second supplemental outlet means preferably is formed by providing for a predetermined axial and/or radial play between the spray arm and the closing member. That is, whereas the first supplemental outlet means provides water in between the bottom side of the spray arm and the upper side of the support member on which the spray arm rests during periods of non-use so as to create a liquid layer of which the spray arm floats during rotation, the second supplemental outlet means which is provided at the upper side of the spray arm, provides for an annular liquid stream, acting as liquid cushion to stabilize rotation of the spray arm.

In embodiments in which axial locking of the spray arm with respect to the mounting element is not required, the mounting element and the support member can be designed as an integral part.

On the other hand, in embodiments in which there shall be provided for axial locking of the spray arm with respect to the mounting element, either a separate locking element can be provided which engages the closing member, which in turn can be designed as an integral part with the support member, or alternatively the closing member and the locking element could be designed as an integral part, in which case the closing member and the support member are designed as engageable members to allow mounting a demounting of the spray arm.

In embodiments in which the liquid inlet is provided at the upper side of the spray arm, the support means preferably is adapted to support the spray arm suspended from the mounting member. In such embodiments axial fixing of the spray arm can be accomplished by providing the closing member with at least one projection which extends laterally outwardly beyond the diameter of the opening in the lower wall of the spray arm, such as a circumferential rim haying a diameter which is larger than the diameter of the opening in the lower wall of the spray arm.

In embodiments in which the liquid inlet is provided at the upper side of the spray arm, the first supplemental outlet means can be formed by providing for a predetermined axial and/or radial play between the spray arm and the closing member, and correspondingly the second supplemental outlet means can be formed by providing for a predetermined axial and/or radial play between the spray arm and the mounting member.

As noted above, the spray arm assembly of the present invention is designed such that the axial forces acting on the spray arm are substantially balanced. This can be accomplished by selecting the flow areas of the spraying nozzles and of the first and second supplemental outlet means such that during periods of use the pressure of the liquid supplied to the spray arm results in an upward force which substantially compensates the weight of the spray arm.

The concept suggested herein is particularly suited for embodiments wherein the spray arm is a satellite arm of a sun arm/satellite arm assembly, wherein at least one satellite arm is rotatably mounted on a sun arm, which in turn is adapted to be rotatably mounted in the wash chamber of the dishwasher. In such sun arm/satellite arm assemblies provisions have to be taken that not only the sun arm rotates within the dishwasher, but also it has to be guaranteed that the satellite arms rotate with respect to the sun arm. While in prior art systems the rotation of the sun arm was mainly caused by the friction of the rotating satellite arms, in systems embodying the present invention, in which friction is greatly reduced, movement of the sun arm is caused mainly by radial forces generated by the rotating satellite(s). Since the axial load on the bearing can be easily adjusted by selecting appropriate flow areas of the first and second supplemental outlet means as well as of the spraying nozzles, movement of the sun arm and satellite arm(s) can be reliably adjusted.

In such embodiments the sun arm can be adapted to be rotatable about a first axis of rotation, and the satellite arm can be mounted on the sun arm to be rotatable about a second axis of rotation which extends in parallel to the first axis of rotation.

The sun arm can be designed as a substantially elongate member having at least one free end, wherein the satellite arm is mounted close to the free end of the sun arm.

It should be understood that the sun arm may be designed in various shapes, for example

- as a single sided arm, one end of which is pivotably mounted to the dishwasher and the other end of which carrying a satellite arm (one free end);
- as a two sided arm comprising two free ends, each carrying a satellite arm, wherein the sun arm can be designed symmetrical about its axis of rotation, or asymmetrical such that the axes of rotation of the satellite arms are located at a different distance from the axis of rotation of the sun arm; or
- as a member comprising three or more symmetric or asymmetric arms each carrying a satellite arm.

Preferred embodiments of the present invention are described below by reference to the drawings in which.

Figure 1:
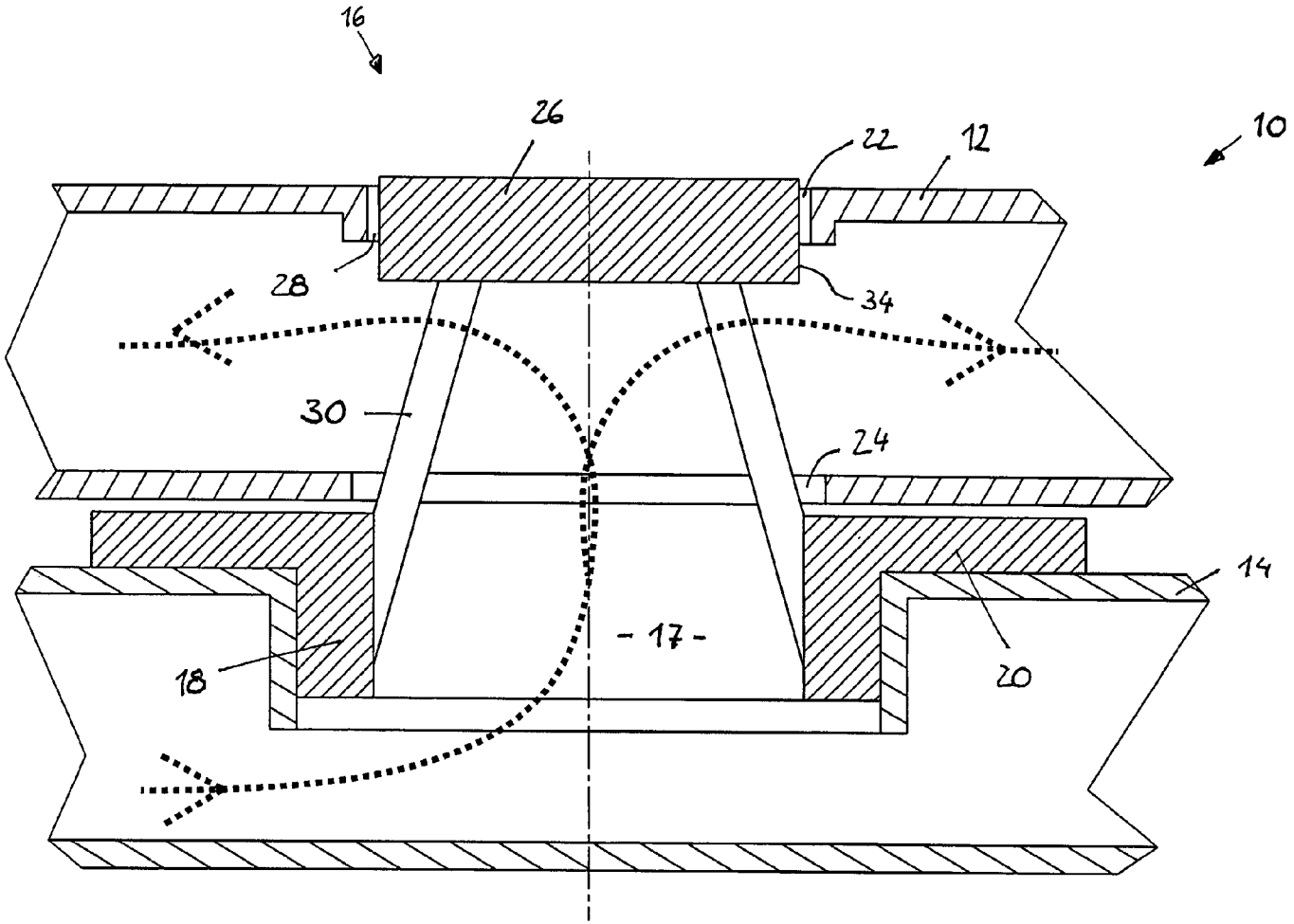
FIG. 1 is a sectional view of a spray arm assembly in accordance with the present invention.

In FIG. 1 there is shown a spray arm assembly for a dishwasher, which is made in accordance with the teachings of the present invention. The spray arm assembly, which generally is designated with 10, comprises a spray arm 12 having a plurality of spraying nozzles which are shown in FIGS. 5 to 8 only. Spray arm 12 is mounted so as to be rotatable within a washing compartment of the dishwasher.

In the embodiment shown in the drawings, spray arm 12 is a satellite spray arm which is rotatably mounted on a sun arm 14 which itself is rotatably mounted within the washing compartment, for example at the bottom of the washing tub. However, it should be noted that the present invention is not restricted to satellite spray arm systems and can be used analogously in connection with standard spray arm systems, in which spray arm 12 is rotatably mounted on the floor of the washing compartment, or suspended from the top wall of the washing compartment or from one of the dish racks. In such embodiments reference sign 14 in FIG. 1 would designate a water feed line which is provided in the bottom of the washing compartment of a dishwasher.

In the satellite spray arm system shown in FIG. 1, as it will be explained in further detail below by reference to FIGS. 7 and 8, a support means generally designated 16, is provided within an opening 17 in the upper side of sun arm 14. Support means 16 comprises a generally annular mounting element 18, which is attached fixedly or releasably to the sun arm 14, for example by means of a thread, a bayonet connection or a snap-in connection (see FIG. 4). Support means 16 further comprises a support member 20 which comprises a substantially flat upper surface on which the spray arm 12 rests during periods of non-use. While mounting element 18 and support member 20 could be designed as separate parts which are connected to each other so as to lower portion of support means 16, in the embodiment shown in FIG. 1 support member 20 is designed as an integral part with mounting element 18.

Spray arm 12 is a hollow member formed of plastics or metal and comprises an upper circular opening 22 and a lower circular opening 24. Support means 16 further comprises a closing member 26, which, when the spray arm 12 is mounted on support means 16, is located within the upper central opening 22 of spray arm 12. Closing member 26 is designed to be slightly smaller than opening 22, so as to leave an annular gap 28 between closing member 26 and the circumferential wall of upper central opening 22.

Closing member 26 is connected to the mounting element 18 in a manner, which allows cleaning liquid to flow upwardly through mounting element 18 and then laterally into the hollow spray arm 12 as it is indicated in FIG. 1 by the dotted lines and arrows. In a preferred embodiment closing member 26 is connected to mounting element 18 by means of a plurality of struts 30. Irrespective of how closing member 26 is connected to mounting element 18, spray assembly 10 is designed such that during periods of use a small portion of the cleaning liquid fed into the spray arm 12 is diverted so as to on the one hand flow between spray arm 12 and support member 20 so as to form a liquid cushion on which the spray arm floats during rotation, and on the other hand to flow through gap 28 so as to stabilize rotation of the spray arm.

Such lifting-off of the spray arm 12 from support member 20 is provided for by suitable dimensioning of the sizes of upper central opening 22 and closing member 26 as well as of the diameter of the central opening within mounting element 18. Thus, for example, if the closing member 26 is small with respect to the cross-sectional area of the central opening within closing member 18, there will be created a larger lifting force acting on spray arm 12, because when the liquid which has been fed upwardly through mounting element 18, preferably wherein said mounting element 18 comprises a central opening or liquid inlet 17, reaches the upper wall of spray arm 12, only a relatively smaller portion of such liquid is deflected laterally into the spray arm and correspondingly a relatively larger liquid portion still flows in a generally upward direction, and thus, passing the circumferential edge of closing member 26, impinges onto the region of the upper wall of spray arm 12 around upper central opening 22.

The upward lifting force acting on spray arm 12 further is dependent on the dimensional relationship between the upper central opening 22 and the size of closing member 26, i.e. depends on the flow area of the annular gap 28 formed between the peripheral wall 34 of closing member 26 and the circumferential wall of upper central opening 22.

Figure 2:
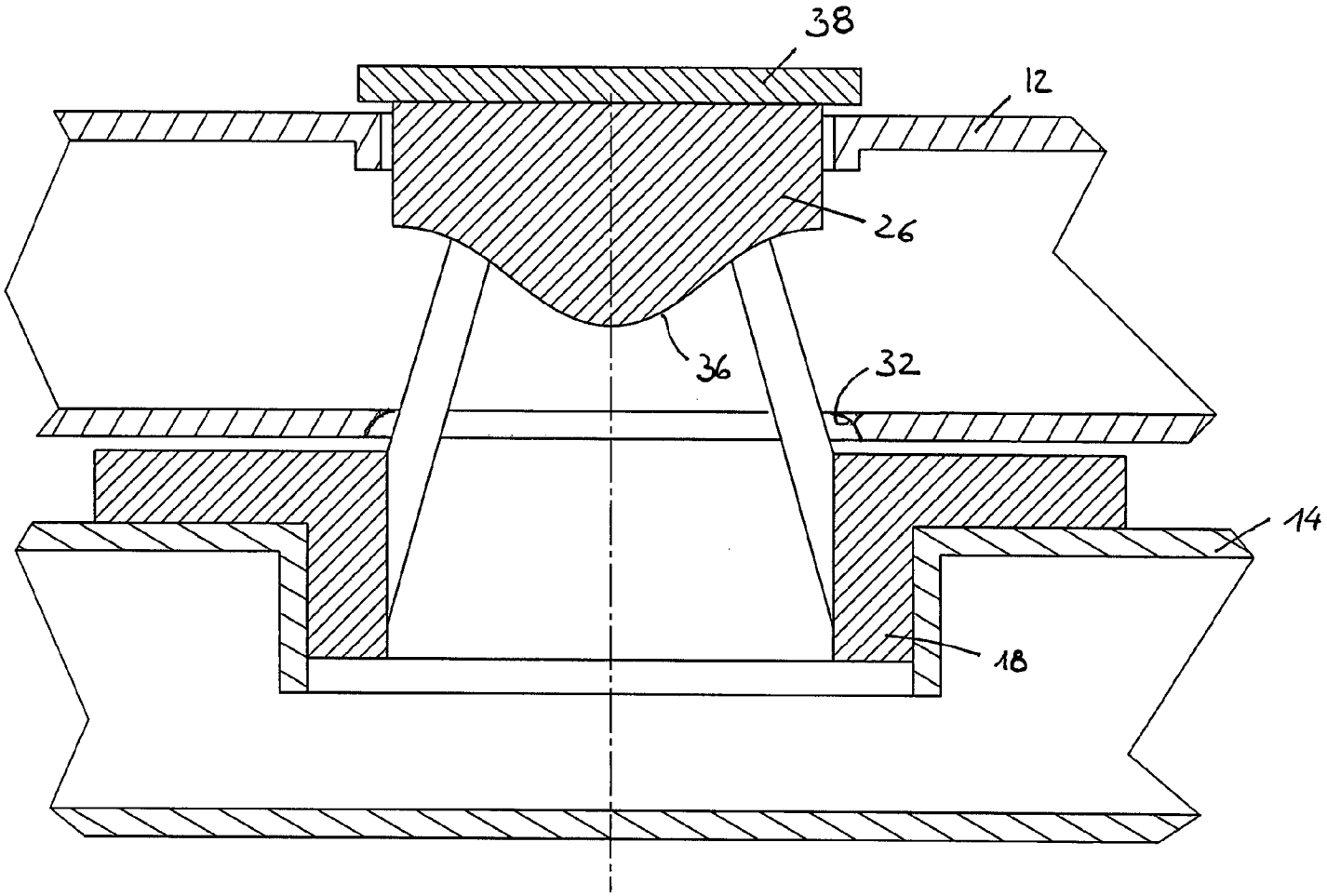
FIG. 2 is a sectional view of another embodiment of the present invention.

The lateral deflection of a small portion of the cleaning liquid into the horizontal gap between the underside of spray arm 12 and the upper side of support member 20 can be further assisted by providing the lower central opening 24 of the spray arm 12 with a curved or slanted edge 32 as it is illustrated in FIG. 2 which shows a modified embodiment of the spray arm assembly shown in FIG. 1.

In the embodiment shown in FIG. 2 the closing member 26 further is provided, on its lower side, with a liquid deflection surface 36, which enhances the lateral deflection of the cleaning liquid entering spray arm 12 via the central opening or liquid inlet 17 within mounting element 18. The liquid deflection surface 36 can be an integral part of closing member 26 or can be part of a separate liquid deflection member, which is attached to the bottom side of closing member 26. In the embodiment shown in FIG. 2 support means 16 further comprises a locking member 38, which limits the upward movement of spray arm 12. Preferably, locking member 38 is connected to closing member 26 in a releasable manner so as to allow disassembly of the spray arm assembly for example for purposes of cleaning spray arm 12.

Figure 3:
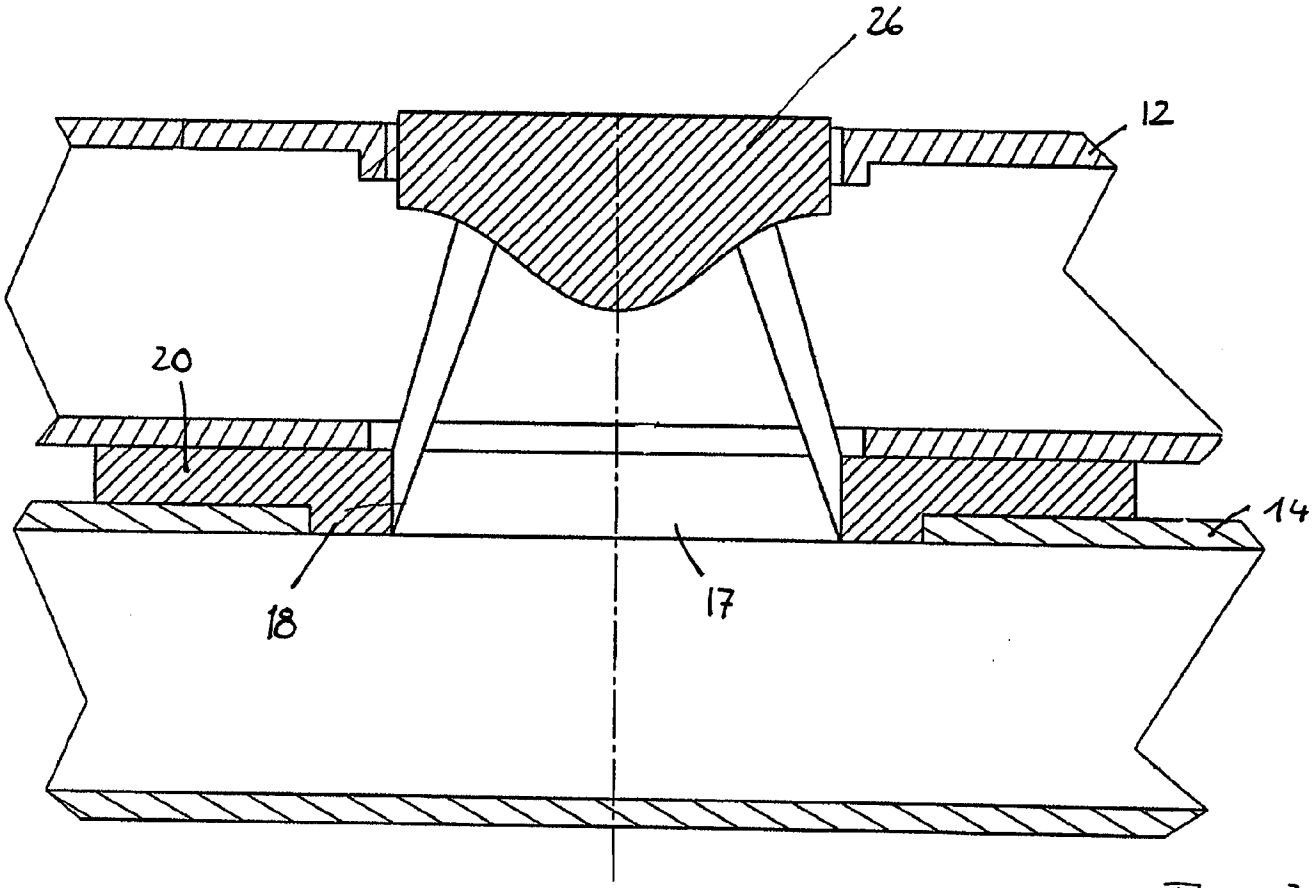
FIG. 3 is a sectional view similar to FIG. 2 of a further modified embodiment.

FIG. 3 shows a modified embodiment of the spray arm assembly in a state of non-use, i.e. at a time when no cleaning liquid is passed into and out of the spray arm and wherein, in the absence of a liquid flow through the spray arm assembly, spray arm 12 rests on support member 20. In the embodiment shown in FIG. 3 mounting element 18 has been shortened with respect to the embodiments shown in FIGS. 1 and 2, so that the bottom side of support member 18 is flush with the inner wall of sun arm 14. In this manner, the flow resistance of the cleaning liquid, which is passed via opening 17 in sun arm 14 into the satellite arm 12, is reduced.

Figure 4:
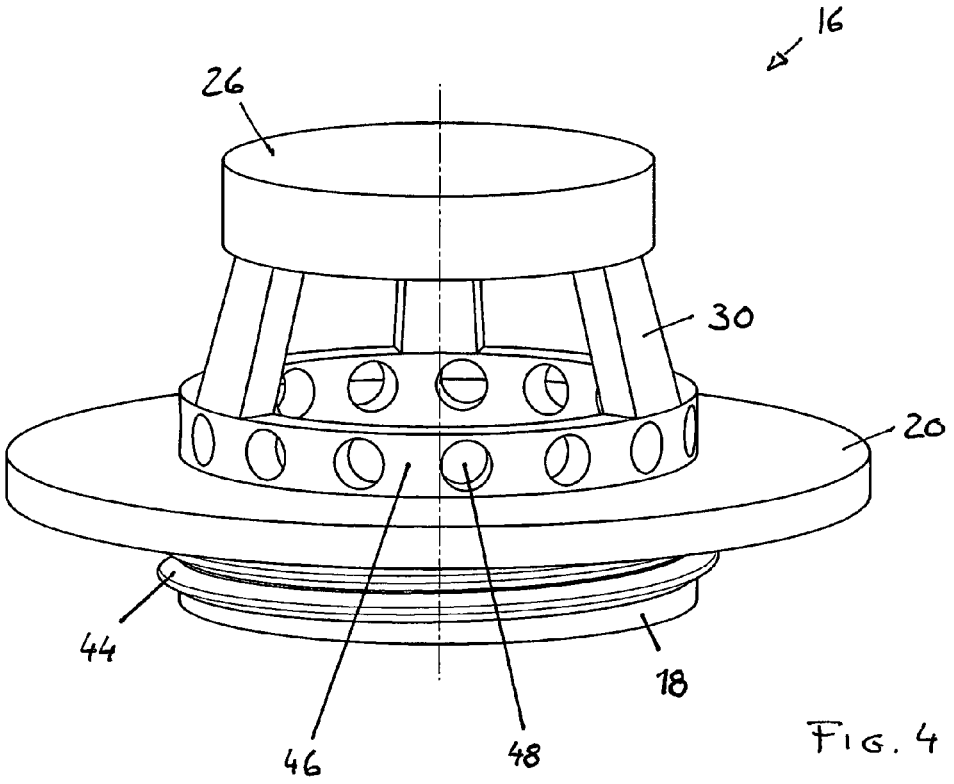
FIG. 4 is a perspective view similar of a further embodiment of a spray arm support means.
Figure 5:
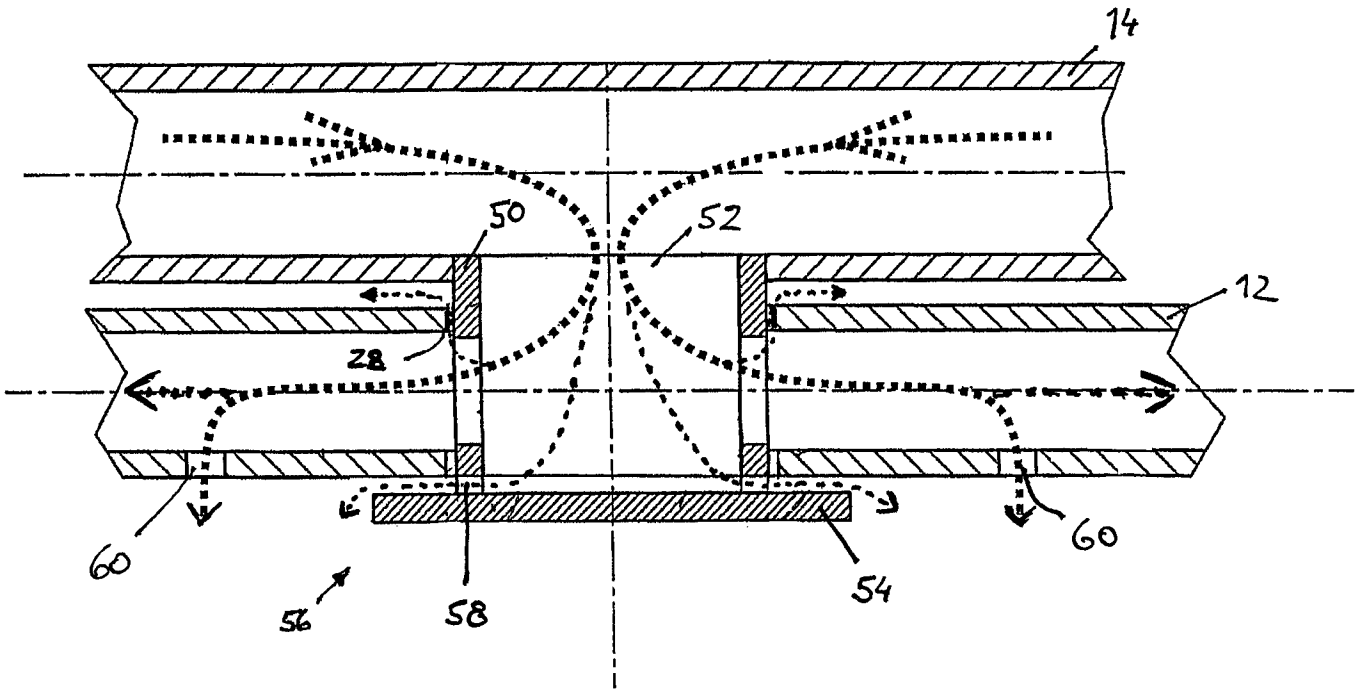
FIG. 5 shows an embodiment of the spray arm assembly which is adapted for suspended mounting.

In FIG. 4 there is shown a further embodiment of spray arm support means 16. Support means 16 may be a single plastic element formed by injection moulding, so that mounting element 18, support member 20, closing member 26 and struts 30 all are integrally connected. In the embodiment shown in FIG. 4 support member 20 is provided at its upper side with a circumferential rim 46 which, when support means 16 is mounted on sun arm 14, surround central opening 17 of sun arm 14. Circumferential rim 46 is provided with a plurality of holes 48 so as to provide that during use of the spray arm assembly, i.e. when a spray arm 12 mounted on support means 16 is lifted off from support member 20 due to the water pressure of the liquid fed into the spray arm, a portion of the liquid is diverted to flow underneath the spray arm 12 as to form a liquid layer between support member 20 and spray arm 12, on which liquid layer the spray arm floats during rotation, FIG. 5 shows an embodiment wherein spray arm 12 is adapted to be mounted within the washing compartment of the dishwasher, so as to be suspended, be it from the top wall of the washing compartment or from a water feed line 14 provided at the underside of an upper rack. As in the embodiments shown in FIGS. 1 to 4, spray arm 12 can be a conventional single arm or a satellite spray arm which is rotatably mounted on a sun arm which itself is rotatably mounted within the washing compartment.

In the FIG. 5 embodiment a support means 56 for mounting the spray 12 within the washing compartment of the dishwasher comprises a mounting element 50 mounted within an opening 52 in the bottom side of a water feed line (or sun arm) 14. Support means 56 further comprises at its lower end a support member 54 on which during periods of non-use spray arm 12 rests. Support means 56 can be designed as an integral part comprising mounting element 50 and support member 54, wherein, to allow for a releasable mounting of spray arm 12, there is provided for a releasable connection between mounting element 50 and water feed line 14. Alternatively, mounting means 56 could designed such that there is provided for a releasable connection between mounting element 50 and support member 54, in which case mounting element 50 could be fixedly mounted within opening 52 of water feed line 14.

Along its bottom end where mounting element 50 is connected to support member 54 there are provided a plurality of openings 58 through which, as is shown in FIG. 5 by the dotted lines and arrows, a portion of the liquid passed into spray arm 12 to be ejected through spraying nozzles 60 is diverted to flow underneath the spray arm 12 as to form a liquid layer between support member 54 and spray arm 12, on which liquid layer the spray arm floats during rotation. In addition, a portion of the liquid passed into spray arm 12 is diverted to flow into an annular gap 28 formed between the circumferential wall of upper central opening of spray arm 12 and the outer side of mounting element 50. During rotation of the spray arm, spray arm 12 thus floats on the water cushion formed between support member 54 and the bottom of spray arm 12, wherein the rotation of spray arm 12 is stabilized by the water layer formed within the annular gap 28 at the upper side of spray arm 12.

Figure 6:
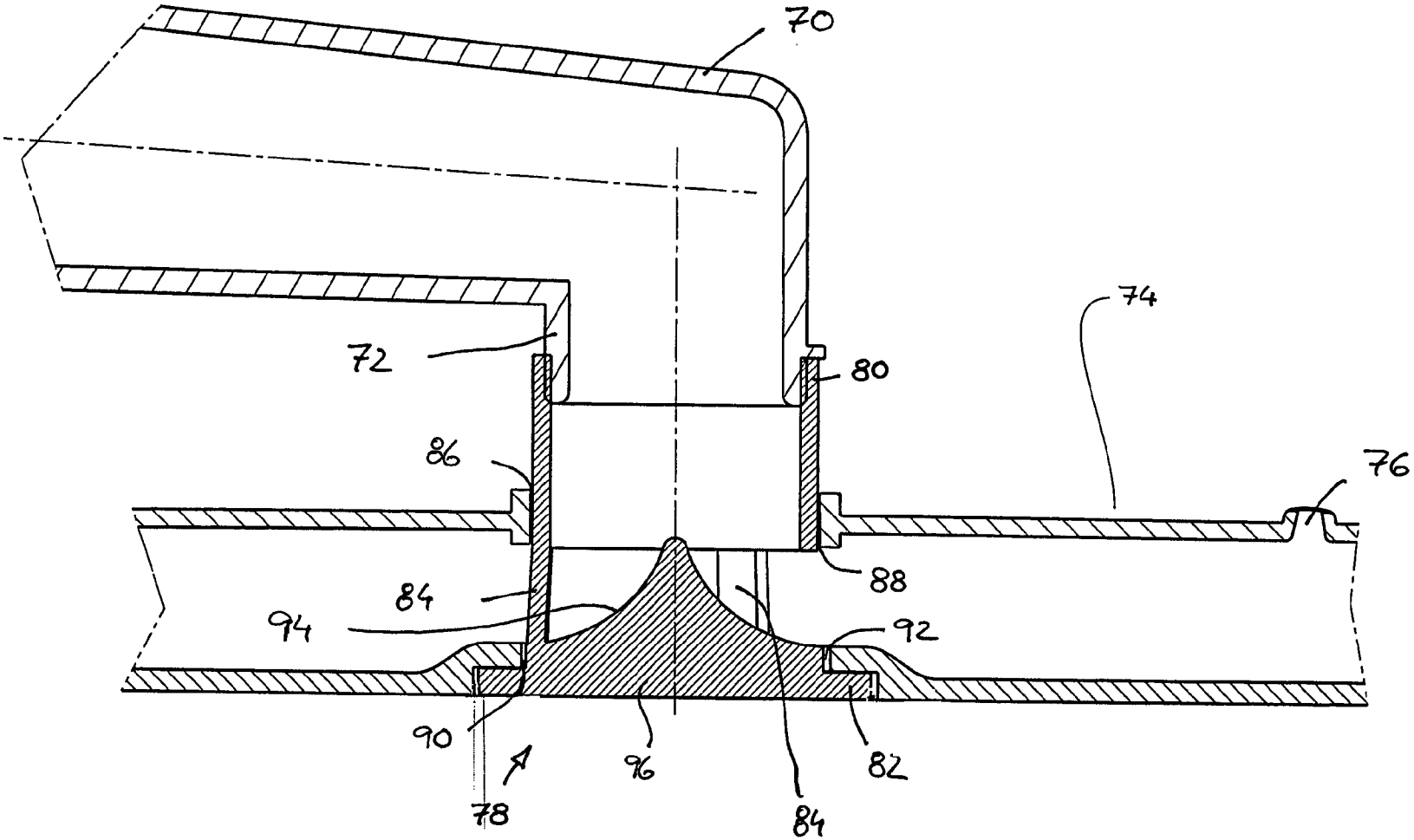
FIG. 6 shows a further embodiment of a spray arm assembly which is adapted for suspended mounting.

In FIG. 6 there is shown a further embodiment of a spray arm assembly which is adapted for suspended mounting. The embodiment shown in FIG. 6 is somewhat similar to the one shown in FIG. 5, but has been adapted for mounting to a water feed line 70 having a bent down portion 72 as it may be provided below an upper dish rack (not shown). The spray arm assembly comprises a spray arm 74 and a support means 78 for mounting the spray arm 74 to bent down portion 72 of water feed line 70. Spray arm 74 comprises a plurality of spraying nozzles 76 which are provided in the upper and/or lower sides of spray arm 74. Additionally, spray arm 74 can be equipped with one or more propelling nozzles which eject a water jet at an angle to the rotational axis of the spray arm so as to impart a momentum on the spray arm for rotating the spray arm.

Support means 78 is a generally tubular element comprising at its upper end a mounting portion 80 adapted to provide for a releasable connection to bent down portion 72 of water feed line 70. To this end mounting portion 80 (and correspondingly bent down portion 72) can be provided with a thread, a bayonet-connection, a snap-in connection or the like. At its lower end support means 78 comprises a support member 82 on which during periods of non-use spray arm 74 rests. In the embodiment shown in FIG. 6 support means 78 is designed as a one-piece component, in which mounting portion 80 is integrally connected to support member 82 by a number struts 84. In the embodiment shown in FIG. 6 support means 78 comprises three struts, only two of which can be seen in the sectional view of FIG. 6.

As in the previous embodiments, spray arm 74 comprises central circular openings 86 and 90 both in its upper and its bottom sides. Upper circular opening 86 is slightly larger than the outer diameter of mounting portion 80 so as to form an annular gap 88 through which during operation of the dishwasher water emerges. Similarly, lower circular opening 90 is slightly larger than the outer diameter of the lower end of support means 78 so as to form an annular gap 92 through which during operation of the dishwasher water emerges. Support member 82 is designed as a rim which laterally projects at the lower end of support means 78 from a central closing member 96 which substantially closes lower circular opening 90 opposite the liquid inlet, on which rim spray arm 74 rests during periods of non-use. At the upper side of central closing member 96 support means 78 further is provided with a curved water deflection surface 94 which directs water flowing downwards into the tubular support means laterally into spray arm 74.

In order to assist water in flowing into lower annular gap 92, water deflection surface 94 and/or the lateral rim forming support member 82 can be provided with a plurality of grooves (not shown). Furthermore, in order to provide for a flush design of the bottom side of spray arm 74 and support means 78, lower circular opening 90 is designed as a stepped bore, wherein the inner bottom wall of spray arm 74 forming the upper edge of lower circular opening 90 is located substantially flush with water deflection surface 94.

In the embodiment of FIG. 6 struts 84 are slightly angled outwards so that annular gap 92 between the lower circular opening 90 and the lower portion of support means 78 has a larger diameter than annular gap 88 formed between upper circular opening 86 and the upper portion of support means 78.

In operation, a portion of the liquid passed into spray arm 74 to be ejected through spraying nozzles 76 is diverted to flow into annular gap 92 and hence underneath the spray arm 12 as to form a liquid layer between support member 82 and spray arm 74, on which liquid layer spray arm 74 floats during rotation. In addition, a portion of the liquid passed into spray arm 74 is diverted to flow into and out of annular gap 88 so as to stabilize rotation of spray arm 74.

Figure 7:
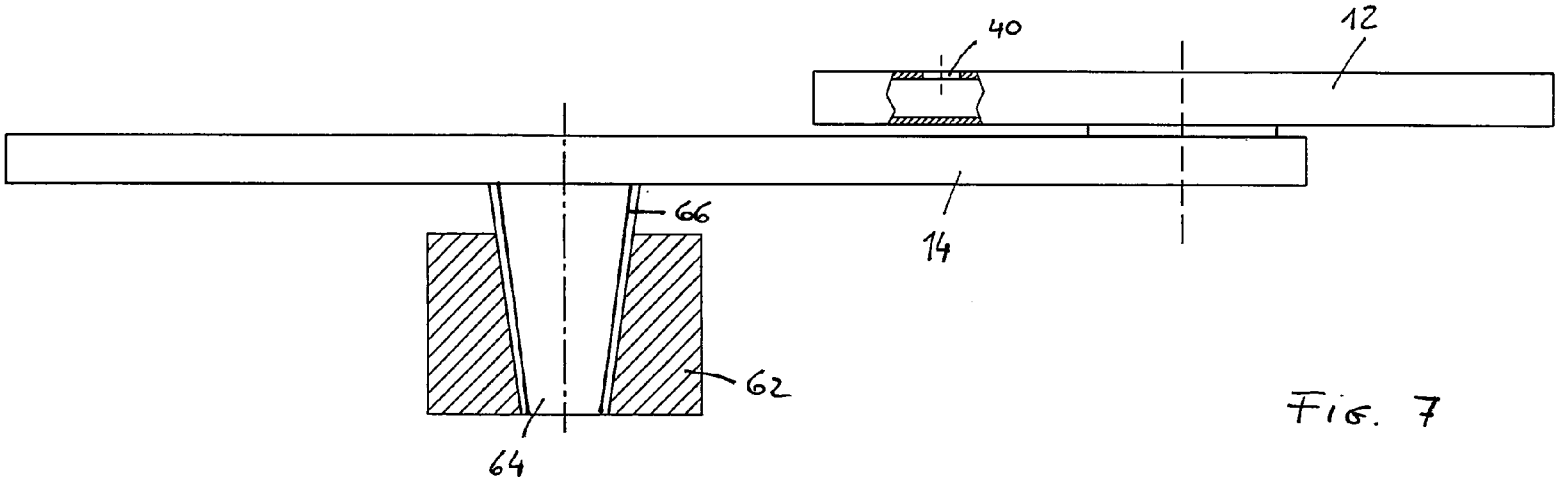
FIG. 7 is a sectional view of a satellite spray arm system.
Figure 8:
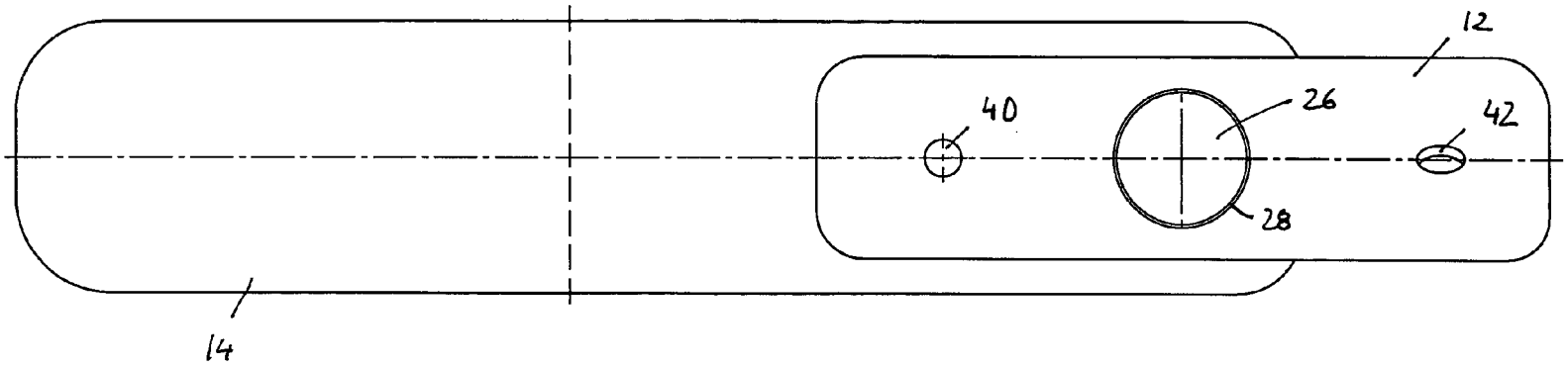
FIG. 8 is top view of the satellite spray arm system of FIG. 7.

In FIGS. 7 and 8 there is shown a satellite spray arm assembly as it can be arranged in the bottom of a washing compartment of a dishwasher. The satellite spray arm assembly of FIGS. 7 and 8 comprises a sun arm 14 adapted to be mounted below a dishware rack on a hub 62 provided in a sump of the dishwasher and which has a feed passage 64 extending there through. The sun arm 14 comprises a conical bearing 66 comprising an intake tube, which bearing allows rotation of the sun arm. The sun arm 14 preferably comprises two hollow and oppositely-directed arm portions, on each of which there is mounted a satellite spray arm 12, only one of which is shown in FIGS. 7 and 8. It should be understood that the satellite spray arm assembly could also comprise just a single satellite spray arm 12, in which case the sun arm 14 could comprise arm portions of different lengths, one of which carrying the satellite spray arm 12 and the other being equipped with spraying nozzles, or alternatively could comprise just a single arm portion on which the satellite spray arm 12 is mounted.

Satellite spray arm 12, and if desired also sun arm 14, comprises a plurality of spraying nozzles 40, 42, some of which may be slanted with respect to the axis of rotation of the spray arm, as it is indicated for nozzle 42, so as to induce a momentum of force to cause the spray arm to rotate as soon as water is ejected from the spraying nozzles.

PREFERRED EMBODIMENTS OF THE INVENTION

One: A spray arm assembly for a dishwasher, comprising a spray arm (12; 74) comprising a plurality of spraying nozzles (40, 42, 60; 76), and a support means (16; 56; 78) for rotational arrangement of the spray arm comprising a mounting element (18; 50; 80) for mounting the support means within the dishwasher and a support member (20; 54; 82) on which the spray arm (12; 74) rests during periods of non-use, characterized in that the spray arm assembly further comprises first supplemental outlet means (24, 48, 58; 92) to direct, during periods of use, liquid to between the support member (20; 54; 82) and the spray arm (12; 74) so as to form a liquid layer between the support member and the spray arm, on which liquid layer the spray arm floats during rotation, and second supplemental outlet means (28; 86) to direct, during periods of use, liquid to between the spray arm (12, 74) and a guiding surface (34) provided at the support means, so as to stabilize rotation of the spray arm.

Two: The spray arm assembly of one, wherein the mounting element (18; 50) comprises a generally ring-shaped element, which forms a liquid inlet for the spray arm (12), and which on its exterior side is provided with fixing means (44) for fixing the mounting element with respect to a dishwasher.

Three: The spray arm assembly of two, wherein the spray arm (12; 74) is designed as a hollow member comprising a central opening (22, 24; 86, 90) in both its upper and lower walls, the support means (16; 56; 82) extending vertically through the spray arm and comprising a closing member (26; 54; 96) which substantially closes the opening in the wall of the spray arm which is located opposite the liquid inlet, in particular wherein the closing member (26; 96) is connected to the mounting element (18; 80) by a plurality of struts (30; 84).

Four: The spray arm assembly of three, wherein the closing member (26; 96) is provided with a liquid deflection surface (36; 94) so as to laterally direct liquid entering the liquid inlet into the interior of the spray arm (12; 74).

Five: The spray arm assembly of any one of two to four, wherein the liquid inlet is provided at the bottom side of the spray arm (12), and the first supplemental outlet means (24) is formed by providing for a predetermined axial and/or radial play between the spray arm (12) and the support member (12).

Six: The spray arm assembly of any one of three to five, wherein the liquid inlet is provided at the bottom side of the spray arm, and wherein the second supplemental outlet means (28) is formed by providing for a predetermined axial and/or radial play between the spray arm (12) and the closing member (26).

Seven: The spray arm assembly of five or six, wherein the mounting element (18) and the support member (20) are designed as an integral part.

Eight: The spray arm assembly of any one of two to four, wherein the liquid inlet is provided at the upper side of the spray arm (12; 74), the support means (56; 78) being adapted to support the spray arm suspended from the mounting member (50; 80).

Nine: The spray arm assembly of any one of three or four, wherein the liquid inlet is provided at the upper side of the spray arm (12; 74), and wherein the closing member (54; 96) comprises at least one projection (82) which extends laterally outwardly beyond the diameter of the opening in the lower wall of the spray arm, in particular wherein the closing member (54; 96) comprises a circumferential rim (82) haying a diameter which is larger than the diameter of the opening (90) in the lower wall of the spray arm (12; 74).

Ten: The spray arm assembly of nine, wherein the first supplemental outlet means (58; 92) is formed by providing for a predetermined axial and/or radial play between the spray arm (12; 74) and the closing member (54; 96).

Eleven: The spray arm assembly of eight to ten, wherein the second supplemental outlet means (28; 88) is formed by providing for a predetermined axial and/or radial play between the spray arm (12; 74) and the mounting member (50; 80).

Twelve: The spray arm assembly of any one of the one to eleven, wherein the flow areas of the spraying nozzles (40, 42, 60; 76) and of the first and second supplemental outlet means (24, 28, 48, 58; 88, 92), are selected such that during periods of use the pressure of the liquid supplied to the spray arm (12; 74) results in an upward force which substantially compensates the weight of the spray arm (12; 74).

Thirteen: The spray arm assembly of any one of one to twelve, wherein the spray arm is a satellite arm (12) which is rotatably mounted on a sun arm (14) adapted to be rotatably mounted in the wash chamber of the dishwasher, in particular wherein the sun arm (14) is adapted to be rotatable about a first axis of rotation and the satellite arm (12) is mounted on the sun arm to be rotatable about a second axis of rotation which extends in parallel to the first axis of rotation.

Fourteen: The spray arm assembly of thirteen, wherein the sun arm (14) is designed as a substantially elongate member having at least one free end and the satellite arm (12) is mounted close to the free end of the sun arm, in particular wherein the sun arm (14) comprises two free ends, each carrying a satellite arm (12).

Fifteen: A dishwasher comprising a spray arm assembly (10) as defined in any one of one to fourteen.

---

10 spray arm assembly
12 spray arm
14 sun arm
16 support means
17 opening, liquid inlet
18 mounting element
20 support member
22 upper circular opening
24 lower circular opening
26 closing member
28 annular gap
30 strut
32 curved or slanted edge
34 peripheral wall
36 liquid deflection surface
38 locking member
40 spraying nozzle
42 spraying nozzle
44 thread
46 circumferential rim
48 holes
50 mounting element
52 opening
54 support member
56 support means
58 opening
60 spraying nozzle
62 feed passage
64 feed passage
66 conical bearing
70 water feed line
72 bent down portion
74 spray arm -continued

| | |
|---|---|
| 76 | spraying nozzle |
| 78 | support means |
| 80 | mounting portion |
| 82 | support member |
| 84 | strut |
| 86 | upper circular opening |
| 88 | annular gap |
| 90 | lower circular opening |
| 92 | annular gap |
| 94 | water deflection surface |
| 96 | central closing member |

The invention claimed is:

1. A spray arm assembly for a dishwasher, comprising:

a satellite arm comprising a plurality of spraying nozzles;

a sun arm, wherein the satellite arm is rotatably mounted to the sun arm; and a support means for rotational arrangement of the satellite arm with respect to the sun arm comprising:

a mounting element for mounting the support means within the dishwasher and a support member on which the satellite arm rests during periods of non-use, a first supplemental outlet means defining a first flow area configured to direct, during periods of use, liquid to between the support member and the satellite arm so as to form a liquid layer between the support member and the satellite arm, on which liquid layer the satellite arm floats during rotation, and a second supplemental outlet means defining a second flow area configured to direct, during periods of use, liquid to between the satellite arm and a guiding surface provided at the support means, so as to stabilize rotation of the satellite arm, wherein the mounting element comprises a liquid inlet for the satellite arm, wherein the satellite arm is designed as a hollow member comprising a central opening in both its upper and lower walls, wherein said support means extends vertically through the satellite arm and comprises a closing member which substantially closes the opening in the upper wall of the satellite arm which is located opposite the liquid inlet and defines a liquid deflection surface so as to direct liquid entering the liquid inlet into the interior of the satellite arm so as to form at least an upward force on the satellite arm to thereby cause the satellite arm to float during rotation, wherein said second supplemental outlet means is defined by both said closing member and said opening in the satellite arm upper wall located opposite said liquid inlet, wherein the liquid deflection surface is further configured to direct water flowing from the liquid inlet directly to the second supplemental outlet means so as to at least partially counteract the upward force on the satellite arm during rotation, wherein the sun arm is adapted to be rotatably mounted in the wash chamber of the dishwasher, and wherein the sun arm is adapted to be rotatable about a first axis of rotation and the satellite arm is mounted on the sun arm to be rotatable about a second axis of rotation which extends in parallel to the first axis of rotation, wherein rotation of the satellite arm and the sun arm is driven by directing liquid through the sun arm and satellite arm, and wherein the first flow area and the second flow area are each dimensioned to enable rotation of the satellite arm and the sun arm while lifting the satellite arm off the sun arm when liquid is directed through the sun arm and the satellite arm.

2. The spray arm assembly of claim 1, wherein a generally ring-shaped element forms said liquid inlet of the satellite arm, wherein said mounting element comprises said generally ring-shaped element that is provided on its exterior side with fixing means for fixing the mounting element with respect to a dishwasher.

3. The spray arm assembly of claim 2, wherein the liquid inlet is provided at the bottom side of the satellite arm, and wherein the second supplemental outlet means is formed by providing for a predetermined axial and/or radial play between the satellite arm and the closing member.

4. The spray arm assembly of claim 1, wherein the closing member is connected to the mounting element by a plurality of struts.

5. The spray arm assembly of claim 1, wherein the sun arm is designed as a substantially elongate member having at least one free end and the satellite arm is mounted close to the free end of the sun arm.

6. The spray arm assembly of claim 5, wherein the sun arm comprises two free ends, each carrying a satellite arm.

7. The spray arm assembly of claim 1, wherein the liquid inlet is provided at the bottom side of the satellite arm, and the first supplemental outlet means is formed by providing for a predetermined axial and/or radial play between the satellite arm and the support member.

8. The spray arm assembly of claim 7, wherein the mounting element and the support member are designed as an integral part.

9. The spray arm assembly of claim 1, wherein the flow areas of the spraying nozzles and of the first and second supplemental outlet means, are selected such that during periods of use the pressure of the liquid supplied to the satellite arm results in an upward force which substantially compensates the weight of the satellite arm.

10. The spray assembly of claim 1, wherein the first supplemental outlet means defines a curved edge defining a downward sloping curve extending away from the second axis of rotation.

11. The spray assembly of claim 1, wherein the support means comprises a locking member disposed proximate a top of the support means and configured to limit upward movement of the satellite arm beyond an upper limit.

12. A dishwasher comprising the spray arm assembly as defined in claim 1.

* * * * *